United States Patent [19]

Hull et al.

[11] 4,361,344

[45] Nov. 30, 1982

[54] SKI BINDING WITH UNIVERSAL RELEASE

[75] Inventors: Maury L. Hull; John E. Ramming, both of Davis, Calif.

[73] Assignee: The Regents of the University of California, Berkeley, Calif.

[21] Appl. No.: 177,263

[22] Filed: Aug. 11, 1980

[51] Int. Cl.[3] ..... A63C 9/08

[52] U.S. Cl. ..... 280/613; 73/862.04

[58] Field of Search ..... 280/613, 623, 618, 611, 280/612; 73/862.02, 862.04

[56] References Cited

U.S. PATENT DOCUMENTS

| | | | |
|---|---|---|---|
| 3,246,907 | 4/1966 | Chisholm | 280/11.35 |
| 3,251,607 | 5/1966 | Wren | 280/11.35 |
| 3,318,610 | 5/1967 | Kulick | 280/11.35 |
| 3,340,726 | 9/1967 | Armstrong et al. | 73/862.04 X |
| 3,367,672 | 2/1968 | Tonozzi et al. | 280/11.35 |
| 3,727,932 | 4/1973 | Druss et al. | 280/11.35 K |
| 3,762,735 | 10/1973 | Smolka | 280/11.35 M |
| 3,774,922 | 11/1973 | Smolka et al. | 280/11.35 M |
| 3,776,566 | 12/1973 | Smolka | 280/11.35 M |
| 3,794,339 | 2/1974 | Smolka | 280/11.35 M |
| 3,802,715 | 4/1974 | Turnheim et al. | 280/11.35 M |
| 3,819,199 | 6/1974 | Smolka et al. | 280/11.35 M |
| 3,820,803 | 6/1974 | Frisch et al. | 280/11.35 M |
| 3,826,509 | 6/1974 | Smolka | 280/11.35 M |
| 3,892,980 | 7/1975 | Anderson | 307/11.35 R |
| 3,902,729 | 9/1975 | Druss | 280/613 |
| 3,907,316 | 9/1975 | Marker et al. | 280/11.35 M |
| 3,919,563 | 11/1975 | Lautier et al. | 307/119 |
| 3,940,156 | 2/1976 | Marker | 280/11.35 R |
| 3,945,656 | 3/1976 | Rohlin | 280/623 X |
| 3,947,051 | 3/1976 | Sittmann | 280/11.35 R |
| 3,960,383 | 6/1976 | O'Neil | 280/612 |
| 4,121,854 | 10/1978 | Cornu | 280/612 |
| 4,126,039 | 11/1978 | Smith et al. | 73/862.04 X |
| 4,291,894 | 9/1981 | Antonio et al. | 280/611 X |

FOREIGN PATENT DOCUMENTS

| | | |
|---|---|---|
| 2200057 | 9/1972 | Fed. Rep. of Germany . |
| 2133675 | 1/1973 | Fed. Rep. of Germany . |
| 2146453 | 3/1973 | Fed. Rep. of Germany . |
| 2402684 | 4/1974 | Fed. Rep. of Germany . |
| 2309888 | 8/1974 | Fed. Rep. of Germany . |
| 1728618 | 10/1976 | Fed. Rep. of Germany . |
| 2705174 | 8/1977 | Fed. Rep. of Germany . |
| 2721691 | 12/1977 | Fed. Rep. of Germany . |
| 2748309 | 5/1978 | Fed. Rep. of Germany . |

OTHER PUBLICATIONS

Hull, Maury, "Computers in Your Skiing Future," *Engineering Progress,* University of California, Davis, vol. 5, No. 1, pp. 2–3 et seq., Spring, 1979.

Allen, Kevin W. and Don Westwood, "A Computer Controlled Snow Ski Binding Release," California Engineer, vol. LVII, No. 3, pp. 28–34, Feb. 1979.

*Primary Examiner*—Robert R. Song

*Assistant Examiner*—Michael Mar

*Attorney, Agent, or Firm*—Fitch, Even, Tabin, Flannery & Welsh

[57] ABSTRACT

A ski binding assembly includes a releasable binding for rigidly securing a ski boot to the ski with a release actuating element for releasing the ski boot from the binding upon occurrence of a release condition determined by a preprogrammed control. The releasable binding includes circular elements, nested one within the other, and a detent for selectively locking the elements together while being capable of unlatching the elements upon operation of the release actuating element.

8 Claims, 4 Drawing Figures

FIGURE 1
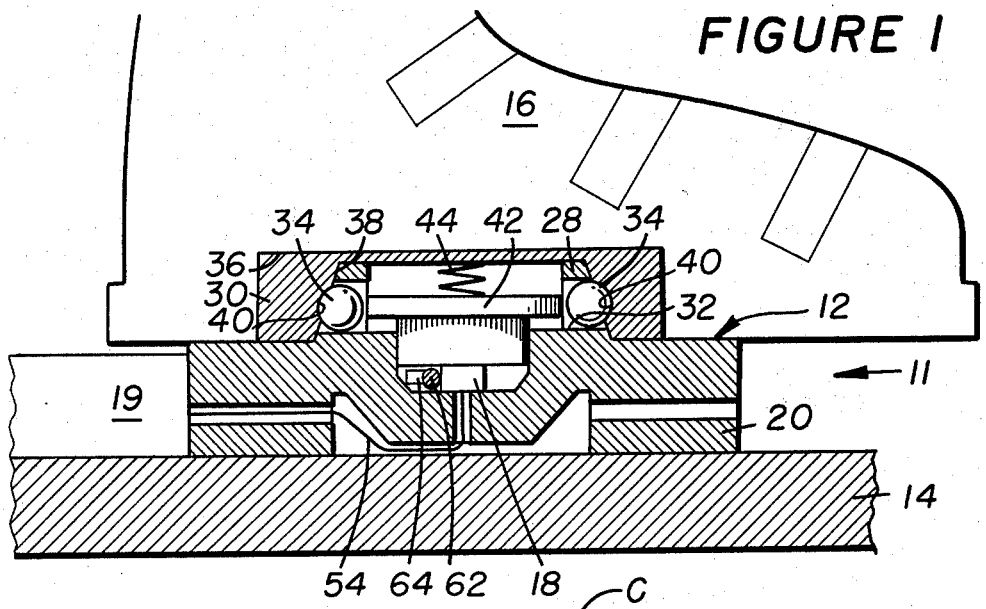
FIGURE 2
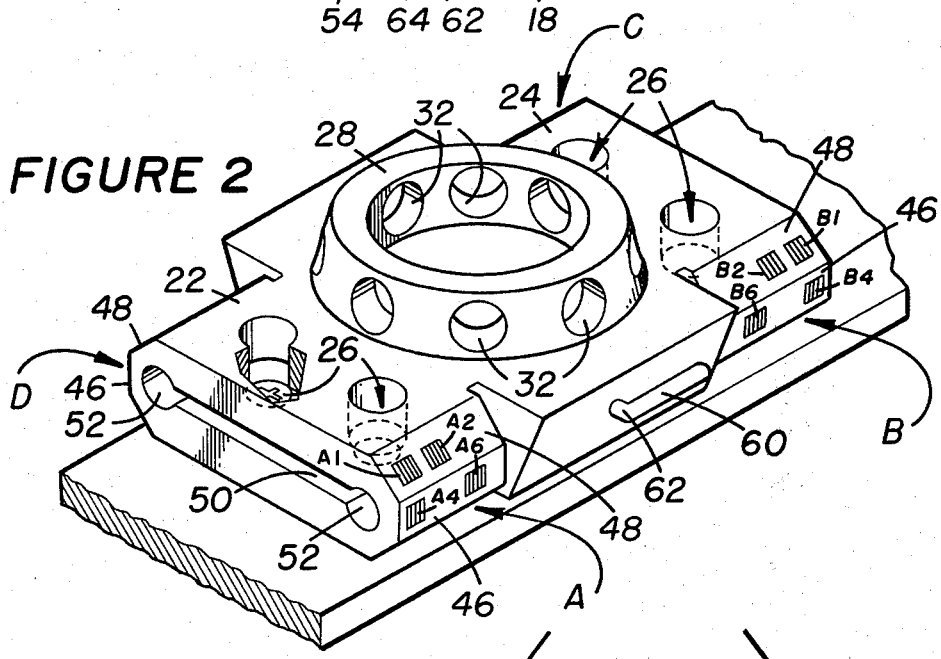
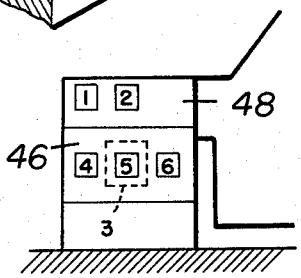
FIGURE 3
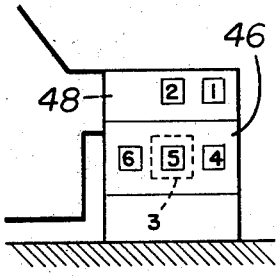
FIGURE 4

SKI BINDING WITH UNIVERSAL RELEASE

BACKGROUND OF THE INVENTION

The present invention relates to ski bindings and more particularly to a ski binding assembly of a type including means for initiating release within the binding in order to prevent or minimize injuries, especially in the lower extremities of the skier.

In view of the increasing popularity of snow skiing, a wide variety of ski bindings has been developed and made commercially available. However, even with improvement of such bindings, the increase in popularity and practice of snow skiing has been accompanied by an increase in injuries, especially in the lower extremities of skiers. Generally, ski injuries have tended to concentrate in the tibia, in the form of mid-length fracture as well as in the ankle and knee.

There has been a substantial effort to improve all types of ski equipment for minimizing such injuries including improvements in ski boots and skis themselves as well as in ski bindings. However, much effort directed toward the elimination or prevention of such injuries has concerned the binding since it has been found that release of the skier from the ski is one of the most effective means of protecting the skier during injury-provoking situations such as falls and the like.

A co-pending application entitled Method and Apparatus for Programmed Release in Ski Bindings, Ser. No. 162,413, filed Jun. 24, 1980 by Maury L. Hull, one of the inventors herein, is directed toward a method and apparatus for achieving programmed release in ski bindings through the operation of control circuits which may comprise for example either analog or digital components. The control circuit described in that application is programmed according to equations developed in a biomechanical model in order to adapt the control circuit for computing predetermined release variables and for comparing those release variables to release criterion in order to precisely generate a release initiating signal. Such a control circuit is preferably contemplated as a release actuating control means for the binding of the present invention.

However, the present invention is specifically directed toward components of the binding itself for securing the ski boot to the ski and for facilitating release therebetween in response to a suitable control means. In this regard, it has been found that ski bindings presently available do not adequately provide for release between the ski boot and ski under the wide variety of injury-provoking situations which may occur during falls and the like.

SUMMARY OF THE INVENTION

It is therefore an object of the present invention to provide an improved ski binding assembly for rigidly securing a ski boot to a ski while having release actuating means responsive to a release actuating control for facilitating release of the boot from the ski when desirable.

More specifically, it is an object of the present invention to provide such a ski binding assembly including a circular releasable binding for enabling release in any direction between the boot and the ski, the circular releasable binding preferably including circular elements arranged parallel with the plane of the ski and being nested one within the other, detent means being adapted for selective locking engagement between the two circular elements and release means being responsive to an initiating signal from release control means for unlatching the detent engagement between the circular elements.

Preferably within the ski binding assembly of the present invention, strain gages or similar means are provided within the binding for producing an electrical signal corresponding to a predetermined type of actual stress formed by interaction between the ski boot and ski, that information being communicated to a release control means for determining when the stresses developed between the boot and the ski are such that loads acting upon the lower extremity of the skier may tend to be injurious in order to thereupon generate a release signal for initiating release of the binding. In a preferred embodiment of the invention, the binding assembly includes dynamometer means for measuring stress developed across the substantially rigid binding between the boot and the ski, the release actuating control means being responsive to the dynamometer means in order to determine when the measured stresses may tend to produce injury in order to thereupon generate a signal for initiating release of the binding. In this regard, the invention preferably contemplates use of analog or digital circuitry of the type disclosed in the above-noted co-pending reference as the release actuating control means. However, it will be apparent that other similar control means could also be employed to perform this function in combination with the binding assembly of the present invention.

Additional objects and advantages of the invention are made apparent in the following description having reference to the accompanying drawings.

BRIEF DESCRIPTION OF THE DRAWINGS

FIG. 1 is a representation, with parts in section, of a preferred embodiment of a ski binding constructed according to the present invention.

FIG. 2 is similarly a representation of a combined dynamometer/releasable binding element within the ski binding of FIG. 1.

FIGS. 3 and 4 are both representations of the arrangement of strain gages on different portions of the dynamometer of FIGS. 1 and 2.

DESCRIPTION OF THE PREFERRED EMBODIMENT

An embodiment of a ski binding assembly constructed in accordance with the present invention is generally indicated at 11 in FIG. 1 and includes a combined dynamometer/releasable binding component 12 which mounts directly upon a ski 14 for binding engagement with a ski boot 16. The binding assembly 11 also includes a release actuating means preferably in the form of a pyrotechnic squib 18 which is responsive to a release actuating control signal from a control circuit generally indicated at 19. The control circuit 19 is described in detail within the above-noted reference which accordingly is incorporated herein for purposes of that disclosure.

The combined dynamometer/releasable binding component 12 includes a structural dynamometer or strain gage element 20 having slotted portions 22 and 24 arranged at opposite ends thereof in order to form four half-strain rings upon which strain gages are mounted in accordance with the following description. The dynamometer element 20 may be attached to the ski for example by screws 26 which engage only the lower portion of the half-strain ring in order to prevent interference with proper operation of the strain gages.

The integral releasable binding portion of the combined dynamometer/releasable binding component 12 includes a pair of annular rings 28 and 30 both lying horizontally above the ski 14. The ring 28 is integrally formed along with the slotted dynamometer portions 22 and 24 and includes a plurality of radially extending, shaped ports 32 for respectively capturing ball bearings 34. The other ring 30 is attached to the boot 16, preferably within a recess 36 formed in the sole of the boot, the ring 30 being of annular configuration with a tapered central cavity 38 adapted for nesting arrangement of the rings 28 and 30 as may be best seen in FIG. 1. The tapered central cavity 38 also includes spherical depressions 40 adapted for detent engagement with the ball bearings 34 in a manner described in greater detail below.

A locking piston 42 is arranged within the ring 28, the ski binding assembly 11 also including a spring means 44 arranged for interaction between the boot 16 and the locking piston 42 in order to urge the locking piston downwardly whereupon the ball bearings 34 are forced outwardly into detent engagement with the spherical depressions 40. With the various components in the configuration illustrated in FIG. 1, the boot 16 is rigidly secured to the ski 14. At the same time, all reaction forces are transmitted between the boot 16 and the ski 14 through the structural dynamometer or strain gage element 20. Accordingly, strain gages may be disposed directly upon the structural dynamometer element 20 in order to monitor those reaction forces.

Referring also to FIGS. 3 and 4, four sets of strain gages are arranged at the four corners of the structural dynamometer element as indicated by the letters A, B, C and D. At each of those locations, the slotted portions 22 and 24 of the structural dynamometer element 20 form a vertical wall 46 and an adjacent wall portion 48 arranged at an angle of 45° to the adjacent wall portion 46. A combination of five strain gages is arranged in each of the locations A–D in order to permit a compensated arrangement of the strain gages within a suitable circuit portion of the control means 19.

The arrangement of the strain gages in the locations A and C is illustrated in FIG. 3 while the arrangement of strain gages at the locations B and D is illustrated in FIG. 4. Furthermore, as noted above, each of the slotted portions 22 and 24 includes a laterally extending slot 50 with a circular opening 52 adjacent each of the strain gage locations A-D. The first and second strain gages are mounted upon the inclined wall portions 48. Accordingly, it may be seen that all of the strain gages in the four assemblies are arranged perpendicular to the longitudinal axis of the ski. This configuration for the strain gages results in a compact and rugged dynamometer which is sensitive to all load components between the ski and boot with the exception of the force component along the longitudinal axis of the ski. It has been determined experimentally that loading in this direction is not of particular significance in predicting release for avoiding ski injuries.

As will be apparent from review of the abovenoted reference, the control circuit means 19 functions upon satisfaction of a release criterion in order to generate a release initiating signal in an output line 54 which is connected with the pyrotechnic squib 18. Detonation of the squib 18 instantly forces the locking piston 42 upwardly against the spring 44, allowing the ball bearings 34 to move radially inwardly and thereupon releasing the boot and outer annular ring 30 from the inner ring 28. Use of the two nested, annular rings 28 and 30 is of particular advantage within the binding assembly 11 because it permits movement of the boot in any direction after release. The tapered annular configurations for the central cavity 38 further contributes to facilitating release in any direction between the rings 28 and 30.

Thereafter, the skier at his option may reactivate the binding 11 by replacing or reenergizing the squib 18 and engaging the ring 30 on the boot with the ring 28, while at the same time urging the locking piston 42 downwardly into the locked configuration illustrated in FIG. 1. The openings or ports 32 which hold the ball bearing 34 are shaped to prevent escape of the ball bearings even when the boot is separated from the ski.

The skier may selectively release the binding in order to separate the boot from the ski by rotating a lever 60 secured to a shaft 62 extending into the cavity 38 beneath the piston 42. The inner end of the shaft is formed with a cam surface 64 for shifting the piston 42 upwardly against the spring 44 in order to release the binding.

The configuration of the binding assembly 11 is selected to provide minimum thickness between the ski boot and the ski.

Accordingly, there has been described a novel ski binding adapted for rigidly securing a ski boot to a ski while facilitating release between the boot and the ski in any direction. Within such a combination, numerous modifications and variations are believed apparent from the preceding description. For example, the release actuating control means 19 and the release actuating squib 18 could be replaced by other components capable of performing those release functions. Accordingly, the scope of the present invention is defined only by the following appended claims.

What is claimed is:

1. A ski binding for releasably securing a ski boot to a ski, comprising a circular releasable binding for selectively engaging the ski boot with the ski, said circular releasable binding including a base portion and two circular elements arranged parallel with the plane of the ski, one of said circular elements being mounted to the underside of the boot and the other of said circular elements being mounted on said base portion, said base portion having a pair of slotted portions extending outwardly therefrom, each of said slotted portions being mounted on said ski, said circular elements being nestable one within the other for positioning the boot relative to the ski, detent means being adapted for selective rigid locking engagement between said two circular elements to secure the boot to the ski, locking means for maintaining the detent means in locked engagement between said two circular elements, release actuating means for releasing the locking means to permit disengagement between said two circular elements and to permit release of the ski boot from the ski when necessary in order to minimize or prevent injury by permitting relative motion in any direction between the boot and ski during release, means for measuring deflection in each of said slotted portions and further for developing a plurality of electrical signals commensurate with selected ones of components of deflection about longitudinal, lateral, and vertical axes of said ski, computing means responsive to said electrical signals for computing angular deflections about selected ones of said axes, said computing means being preprogrammed with predetermined critical angular deflections for computing a relationship between said electrical signals for initiating a release signal to said release actuating means.

2. The ski binding of claim 1 further comprising additional manually operable means for selectively releasing the locking means to permit disengagement between said two circular elements and release of the ski boot from the ski.

3. The ski binding of claim 1 wherein mating surfaces of the circular elements taper radially inwardly and upwardly in order to facilitate release of the boot from the binding.

4. The ski binding of claim 1 further comprising spring means arranged for interaction between the ski boot and said locking means for positioning said locking means in order to maintain said detent means in positive locking engagement.

5. The ski binding of claim 4 wherein said release actuating means is arranged for interaction with said locking means to urge it against said spring means for releasing locking engagement of said detent means.

6. The ski binding of claim 1 wherein said detent means comprises a plurality of detent balls carried by one of said circular elements for locking engagement with annular recess means in the other of said circular elements.

7. The ski binding of claim 1 wherein said release actuating means comprises a pyrotechnic device.

8. The ski binding of claim 1 wherein said measuring means includes a plurality of strain gauges mounted on said slotted portions.

* * * * *